US006738085B2

(12) United States Patent
Hachinoda

(10) Patent No.: US 6,738,085 B2
(45) Date of Patent: May 18, 2004

(54) PRINTING APPARATUS AND COMMUNICATION APPARATUS AND INFORMATION PROCESSING APPARATUS HAVING THE SAME

(75) Inventor: Masayuki Hachinoda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 28 days.

(21) Appl. No.: 09/984,387

(22) Filed: Oct. 30, 2001

(65) Prior Publication Data

US 2002/0051050 A1 May 2, 2002

(30) Foreign Application Priority Data

Oct. 30, 2000 (JP) ..... P2000-331297

(51) Int. Cl.[7] ..... B41J 2/32; B41J 2/35

(52) U.S. Cl. ..... 347/171; 347/211

(58) Field of Search ..... 347/171, 211, 347/185, 191, 197, 215, 19, 180–182; 400/120.01, 120.05, 120.07, 120.08, 120.1, 120.11, 120.14, 54; 358/296, 521, 522

(56) References Cited

U.S. PATENT DOCUMENTS 4,500,893 A * 2/1985 Sakura et al. ..... 347/211
4,769,657 A * 9/1988 Takahashi ..... 347/171
5,353,044 A * 10/1994 Nakano et al. ..... 347/211
5,682,504 A * 10/1997 Kimura et al. ..... 358/1.4
5,951,175 A 9/1999 Kawamori ..... 400/120.01

FOREIGN PATENT DOCUMENTS

JP 60-92876 A * 5/1985
JP A63-145058 6/1988
JP A63-227356 9/1988
JP A3-193367 8/1991
JP 406071926 A * 3/1994 ..... B41J/2/375
JP A7-9691 1/1995
JP A11-254722 9/1999

* cited by examiner

*Primary Examiner*—K. Feggins
(74) *Attorney, Agent, or Firm*—Birch, Stewart, Kolasch & Birch, LLP

(57) ABSTRACT

A printing apparatus includes a defect detection unit, and when print data to cause all of one line to be blank is inputted to a thermal head, in parallel with printing of a blank line, a transistor for short-circuiting a current detection resistor becomes in an OFF state, the current detection resistor is made conductive, values of currents flowing through respective heaters are compared with a predetermined comparison signal in order of first to fourth strobes for dividing a heater array of the thermal head, and the defect of the thermal head is detected from this comparison result.

16 Claims, 5 Drawing Sheets

PRINTING APPARATUS AND COMMUNICATION APPARATUS AND INFORMATION PROCESSING APPARATUS HAVING THE SAME

BACKGROUND OF THE INVENTION

1. Field of the Invention

The present invention relates to a printing apparatus using a line type thermal head for printing on a recording sheet such as a thermal paper or thermal transfer sheet, capable of automatically detecting a defect of the thermal head, and a communication apparatus and an information processing apparatus, provided with the same.

2. Description of the Related Art

Conventionally, in a printing apparatus which uses a thermal head to print on a recording sheet, there has been a problem that when a defect occurs in the thermal head, respective heaters of the thermal head generate heat, and a trouble such as destruction or burnout of the thermal head occurs. When such a trouble occurs, a serious influence is exerted also on a printed image. In view of such a problem, for the purpose of confirming the quality of a printed image, a method in which a current is made to flow through a thermal head during printing or at the point of time when the thermal head is not used, for example, immediately before the printing, and a defect of the thermal head is detected through the value of the current, is known as a well-known technique.

Besides, a method of detecting a defect of a thermal head or preventing a trouble is disclosed in, for example, Japanese Unexamined Patent Publications JP-A 63-227356 (1988), JP-A 63-145058 (1988), JP-A 3-193367 (1991), JP-A 7-9691 (1995), or JP-A 11-254722 (1999).

JP-A 63-227356 discloses a method in which an inspection signal as data is inputted to a thermal head which is divided into a plurality of parts of data by a plurality of strobe signals which sections of data are printed in different printing timings, blocks divided by the plurality of strobe signals are forcibly turned on, a power source of the thermal head is switched to an inspection power source line, and currents flowing through respective heaters are detected, so that a defect of the thermal head is detected.

JP-A 63-145058 discloses a method in which a current flowing through a thermal head is detected at every printing line, the detection current is compared with a reference value set in accordance with a thermal head current corresponding to the minimum number of printing dots per line, defect detection of the thermal head is carried out through the number of lines at which the value of the detection current exceeds the reference value, and the quality of printing is judged.

JP-A 3-193367 discloses a method in which a current flowing through a thermal head in a time other than a printing time is detected by a voltage drop through a resistor provided in a supply power source of the thermal head, and when abnormality is detected by detection means, the supply power source is turned off.

JP-A 7-9691 discloses a method in which dot information for specifying at least one heater used for abnormality detection is generated, electric power is supplied from a power source to only the heater used for abnormality detection, and a voltage drop of the heater supplied with the electric power is compared with a threshold voltage so that abnormality is detected.

JP-A 11-254722 discloses a method in which when first power supply means does not supply electric power for printing, second power supply means supplies electric power for detection to a thermal head through failure detection means, and defect detection of the thermal head is carried out based on a current flowing through at least one heater.

However, in the publication, in the case where defect detection of the thermal head is carried out during the printing, a specific procedure for interrupting the printing and for detecting a defect of the thermal head is required. Besides, the detection of the defect of the thermal head is carried out during the printing or immediately before the printing. Accordingly, it is impossible to detect such a trouble that for example, the thermal head suddenly fails in a state where printing is not made, or a control program is out of control, and a current flows through the thermal head in a time other than a printing time to cause heat generation with a heater, so that destruction, burnout or the like of the thermal head occurs.

SUMMARY OF THE INVENTION

An object of the present invention is to provide a printing apparatus using a thermal head in which defect detection of the thermal head is carried out during printing by a simple method without interrupting the printing and the thermal head is always monitored with respect to abnormality over a period including a printing time and a waiting state, to prevent a trouble such as destruction and burnout of the thermal head, and a communication apparatus and an information processing apparatus, provided with the same.

The invention provides a printing apparatus comprising:

a line type thermal head having a heater array composed of a plurality of heaters, for printing on a recording sheet; and defect detection means for, in the case where print data to cause all of one line to be blank is inputted to the thermal head, detecting a defect of the thermal head based on a current flowing through each heater at a time of printing of the blank line.

Since the thermal head prints by heat generation, if a defect occurs in the thermal head, abnormality occurs in a printed image, and the thermal head generates heat, so that the trouble such as destruction and burnout of the thermal head can occur. According to the invention, in the case where the print data to cause all of one line to be blank is inputted to the thermal head at the time of the printing, the defect of the thermal head can be detected based on the current flowing through each heater. Accordingly, the defect of the thermal head can be detected during the printing without interrupting the printing.

In the invention it is preferable that print data for one line is divided into a plurality of parts of data by strobe signals which parts of data are printed in different print timings, and defect detection of the thermal head is carried out for respective blocks divided by the strobe signals.

According to the invention, the print data is divided into the plurality of parts of data by the strobe signals, and defect detection of the thermal head can be carried out for each block of the thermal head. Accordingly, a defect portion of the thermal head can be specified. Besides, since the element number of the heaters detected at the same time becomes small, even if leak currents of drive circuits of the respective heaters are accumulated, the influence on the detection of the defect of the thermal head becomes weak.

Besides, the invention is characterized in that the defect detection means comprises a resistor which is interposed in a power source line of the thermal head and detects a current supplied to the thermal head when print data to cause all of one line to be blank is inputted to the thermal head, and a circuit for short-circuiting the resistor in the case where all of one line is not blank.

According to the invention, in the defect detection means, in the case where the print data to cause all of one line to be blank is inputted to the thermal head, the current supplied to the thermal head is detected by the current detection resistor interposed in the power supply line of the thermal head, and in the case where the print data not to cause all of one line to be blank is inputted to the thermal head, the current is supplied to the thermal head through the circuit for short-circuiting the resistor. The circuit for short-circuiting the current detection resistor can prevent the current applied to each heater from being changed by the voltage drop at the current detection resistor.

Besides, the invention is characterized in that the defect detected by the defect detection means is classified into a plurality of stages in accordance with the stage of the defect, a processing after defect detection is also classified into a plurality of stages made of a combination of an alarm occurrence and a printing stop, and a processing classification after the defect detection is assigned in accordance with the classification of the defect.

According to the invention, the defect detected by the defect detection means is classified into, for example, three stages in accordance with the stage of the defect, and the alarm of the trouble of the thermal head is issued at the respective stages to notify the user, and at the same time, when the stage of the trouble is raised, for example, the printing is automatically stopped, so that it is possible to prevent the trouble such as the poor quality of a printed image and the fatal destruction and burnout of the thermal head caused by the heat generation of the heater.

Besides, according to the invention, defects detected by the defect detection means are classified into the plurality of stages in accordance with levels of the defect, the measures after the defect detection are also classified into the plurality of stages composed of combinations of alarm occurrence and printing stop, and assignment of measure classification after the defect detection is carried out in accordance with the classification of defects, so that it is possible to prevent the trouble such as poor quality of printed image and the fatal destruction and burnout of the thermal head caused by heat generation of the heater.

In the invention it is preferable that in the case where print data to cause all data of one line to be blank is not inputted to the thermal head with respect to a predetermined printing amount, or every predetermined printing amount, print data to cause all of one line to be blank is forcibly inserted.

According to the invention, when the printing amount, for example, the number of pages, the number of lines, or the length of printing (the number of characters) is predetermined, and when printing of the printing amount is carried out, the print data to cause all of one line to be blank is forcibly inserted. Alternatively, the blank data of one line is inserted every predetermined printing amount, for example, in the first line of every page, irrespective of whether or not all of one line is blank. Accordingly, even in the case where the print data to cause all of one line to be blank does not exist in an image to be printed, the defect of the thermal head can be certainly detected.

In the invention it is preferable that when the print data to cause all of one line to be blank is forcibly inserted, a recording sheet is not advanced in printing of this line.

According to the invention, the recording sheet such as a thermal paper or a thermal transfer paper is not advanced with respect to the line in which the print data to cause all of one line to be blank is forcibly inserted. Accordingly, even if the print data to cause all of one line to be blank is forcibly inserted, the blank line is not printed.

The invention provides a printing apparatus comprising:

a line type thermal head having a heater array composed of a plurality of heaters, for printing on a recording sheet; and defect detection means for, over a period including a printing time and a waiting state, detecting a current flowing through the thermal head by inserting print data to cause all of one line to be blank each time when a predetermined time elapses, or detecting the current flowing through the thermal head at a point of time when a strobe signal is not inputted, and detecting a defect of the thermal head based on the detected current.

According to the invention, the defect of the thermal head can be detected each time the predetermined time elapses over the period including not only the printing time but also the waiting state. Accordingly, since the defect of the thermal head can always be detected irrespective of the printing, it is possible to prevent the trouble such as destruction and burnout of the thermal head caused by the heat generation of the heater.

In the invention it is preferable that when the detection means detects the defect of the thermal head, a current to the thermal head is cut off.

According to the invention, when the defect detection means detects the defect of the thermal head, the current to the thermal head is cut off, so that it is possible to prevent the trouble such as destruction and burnout of the thermal head caused by the heat generation of the heater in advance.

The invention provides a communication apparatus comprising the above-mentioned printing apparatus.

Besides, the invention provides an information processing apparatus comprising the above-mentioned printing apparatus.

According to the invention, the printing apparatus can be used for the communication apparatus such as a facsimile or the information processing apparatus such as an Internet facsimile.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
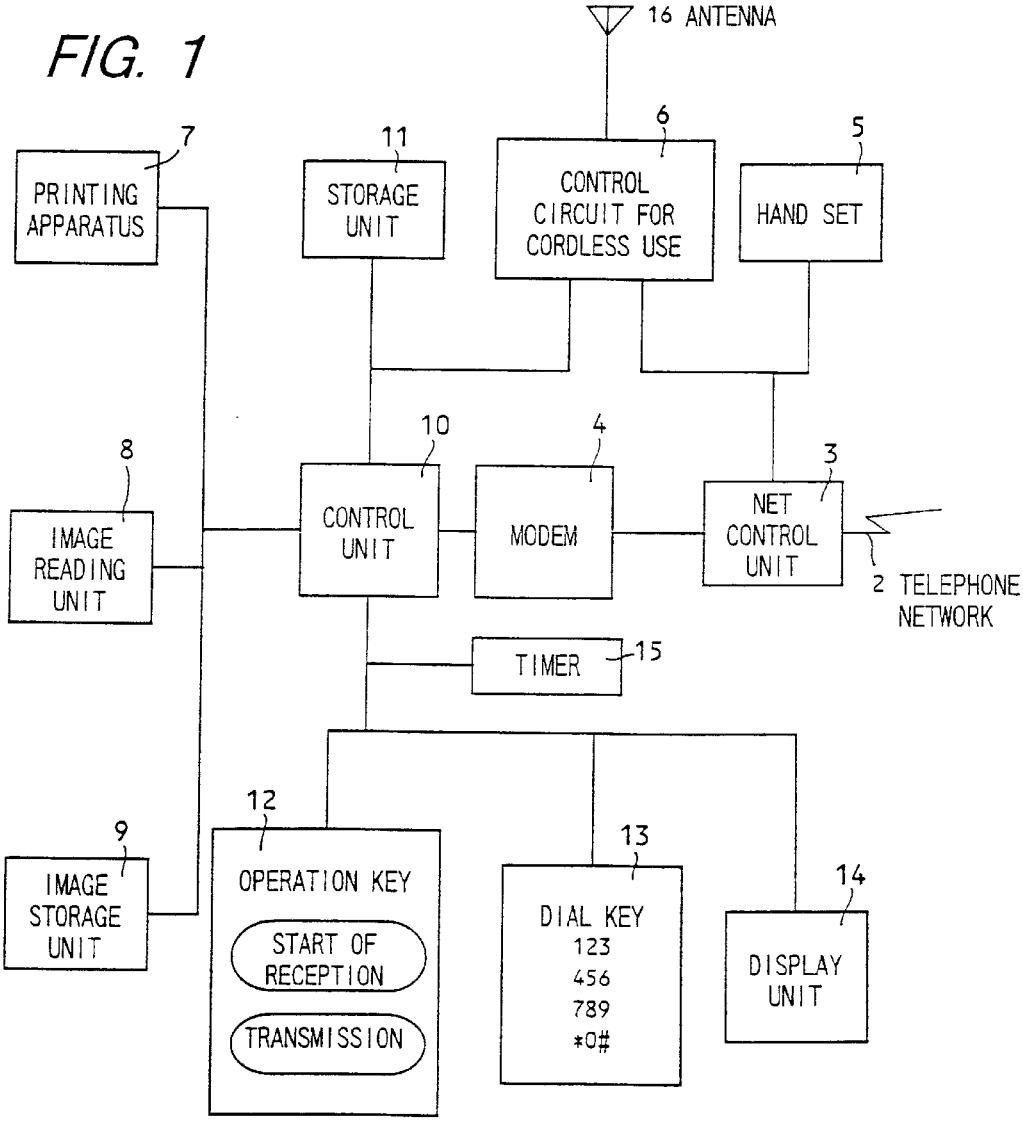
FIG. 1 is a block diagram showing a facsimile apparatus 1 of an embodiment of the invention.

Now referring to the drawings, preferred embodiments of the invention are described below.

An embodiment of the invention will be described using a facsimile apparatus 1 of a communication apparatus as an example.

FIG. 1 is a block diagram of a facsimile apparatus 1 in an embodiment of the invention. The facsimile apparatus 1 is connected to a telephone network 2 through a net control unit 3, and includes a modem 4, a hand set 5, a control circuit 6 for cordless use, a printing apparatus 7, an image reading unit 8, an image storage unit 9, a control unit 10, a storage unit 11, an operation key 12, a dial key 13, a display unit 14, a timer 15, and an antenna 16.

The net control unit 3 monitors the state of the telephone network 2 and switches a line to the side of the modem 4, or the side of the hand set 5 and the side of the control circuit 6 for cordless use. The modem 4 modulates a digital signal of an image into an analog signal suitable for the telephone network 2, and demodulates an analog signal of the telephone network 2 into a digital signal for printing.

The printing apparatus 7 is a unit for printing a received image or an image read by the image reading unit 8, and is a printing apparatus which includes a line type thermal head having a heater array composed of a plurality of heaters, and prints on a recording sheet such as a thermal paper or a thermal transfer paper. The image reading unit 8 is a unit for reading an original for transmission or copying, and uses a reduction read system by a combination of a lens and a CCD line sensor, a contact sensor system using a rod lens array, or the like. The image storage unit 9 is a unit for storing the read image or received image, and by including this unit, many complicated functions, for example, transfer of the received image, notification thereof, substitute reception in the case where, for example, there is no recording sheet such as a thermal paper or a thermal transfer paper, memory transmission, and the like become possible.

The control unit 10, together with a program stored in the storage unit 11, determines the operation of the whole apparatus based on input information from the operation key 12 and the dial key 13, information indicating the state from each unit of the apparatus, and information of signals from the telephone network 2, gives instructions to the whole apparatus, and issues instructions of display to the display unit 14. Further, the control unit 10 has a function of compression to shorten a transmission time of information of an image, and a function of expansion to return the compressed image signal to the original pixel column information.

Although the timer 15 is a unit normally included in a part of the control unit 10, since it has an important function in the invention, it is especially shown. If a specific time is set in this timer 15, a control program is interrupted when the time elapses, and the control can be changed from a normal operation procedure to an interrupt operation procedure. The operation key 12 and the dial key 13 are units for the user to input information and instructions. The display unit 14 is a unit for the facsimile apparatus 1 to display information to the user and to make guidance, and it becomes possible to set various parameters of the facsimile apparatus 1 in dialogue by using the display unit 14, the operation key 12 and the dial key 13. The hand set 5 is provided with a receiver and a transmitter for a telephone call.

The facsimile apparatus 1 of this embodiment can be connected to one or plural cordless extensions, and the control circuit 6 for cordless use is a device for controlling a not-shown cordless extension and includes a tuner for search of a speech path for connection with an extension, establishment of connection, telephone call, electric wave transmission and reception, and the like. The antennal 16 transmits and receives an electric wave for transmission to and reception from the cordless extension.

Next, the printing apparatus 7 will be further described in detail.

Figure 2:
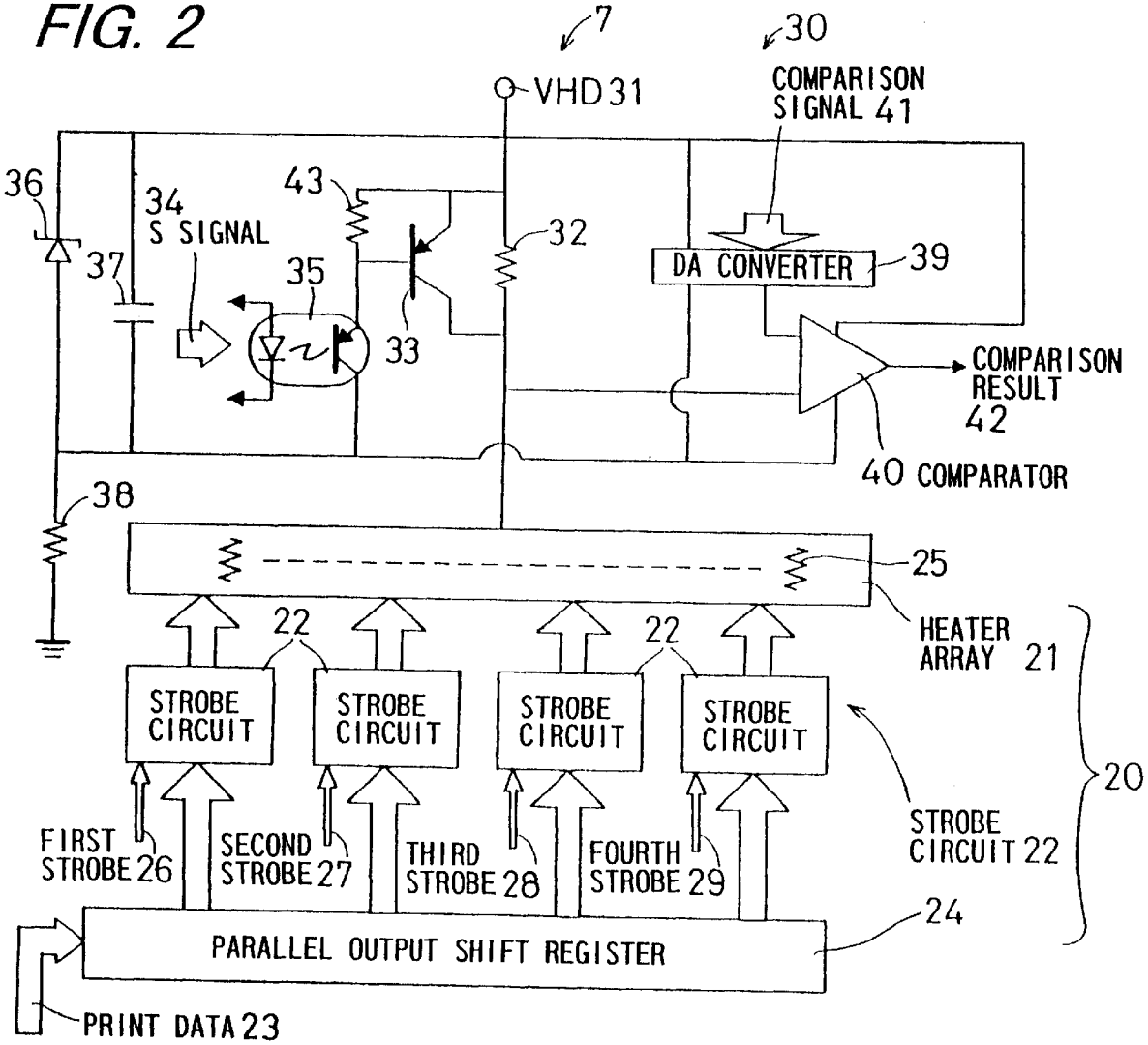
FIG. 2 is a view showing a thermal head 20 and a defect detection circuit 30 in a printing apparatus 7 of the facsimile apparatus 1 of FIG. 1.

FIG. 2 is a view showing a thermal head 20 in the printing apparatus 7 and a defect detection circuit 30 for detecting a defect of the thermal head 20. The thermal head 20 is constituted by a heater array 21, a strobe circuit 22 divided into, for example, four parts, and a parallel output shift register 24 for receiving image data 23 in series and outputting it to the heater array 21 in parallel.

In the heater array 21, heaters 25 generating heat at the time of printing are arranged in a line at intervals of, for example, 8 elements/mm. The print data 23 for one line, inputted in series, is stored in the parallel output shift register 24, and is outputted to the heater array 21 in parallel. In general, when all the heaters are activated at the same time, since a large current flows at the same time, the heater array 21 is divided into, for example, four parts, and an electric current is separately applied four times. The strobe circuit 22 performs this division, and drives the heater array 21 by, as signals inputted from the control unit 10, a first strobe 26, a second strobe 27, a third strobe 28, and a fourth strobe 29 in order. The strobe circuit is a driver circuit for controlling a current applying time of the heater 25 by the strobe signal. The first strobe 25 to the fourth strobe 29 are also used for finely controlling the current applying time of the current flowing through the heater 25 by conditions such as the temperature of the thermal head 20 and printing history up to this time. Although the number of divisions of the heater array 21 divided by the strobe circuit 22 is four in this embodiment, the invention is not limited to this.

The defect detection circuit 30 includes a transistor 32, a photo coupler 35, a Zener diode 36, a capacitor 37, resistors 38, 43, a DA converter 39, and a comparator 40.

A current is supplied to the heater array 21 of the thermal head 20 from a VHD 31 (for example, 24 V power source) as a power source. The current detection resistor 32 between the VHD 31 and the thermal head 20 is a resistor for detecting a current flowing through the thermal head 20. The current is detected by this current detection resistor 32, and in the case where print data to cause all of one line to be blank is inputted to the thermal head 20, the current detection resistor 32 is short-circuited by a transistor 33 as a part of a circuit for short-circuiting the current detection resistor 32.

This prevents a voltage applied to the heater array 21 from being changed by a voltage drop in the current detection resistor 32. Since driving of this transistor 33 is performed by an S signal 34 as an instruction signal of the control unit 10, a difference in the voltage level between the control unit 10 and the transistor 33 is converted by the photo coupler 35. The resistor 43 is a resistor for ensuring the stability of the operation of the transistor 33. The Zener diode 36, the capacitor 37 and the resistor 38 constitute a power source for driving the photo coupler 35, the DA converter 39 and the comparator 40.

The current flowing through the thermal head 20 is converted into a voltage by the current detection resistor 32, and is inputted to one input terminal of the comparator 40. A comparison signal 41 for comparison with the voltage converted by the current detection resistor 32 is inputted from the control unit 10 to the other input terminal of the comparator 40, and this comparison result 42 is returned to the control unit 10. The comparison signal 41 inputted to the DA converter 39 and the comparison result 42 outputted from the comparator 40 are converted, although not shown, from a voltage level prepared by the Zener diode 36, the capacitor 37, and the resistor 38 to a voltage level of the control unit 10.

The transistor 33 is turned off, that is, the current detection resistor 32 is changed from a short-circuited state to a conductive state by the circuit as described above, so that the defect of the thermal head can always be detected based-on the current flowing through the thermal head.

Figure 3:
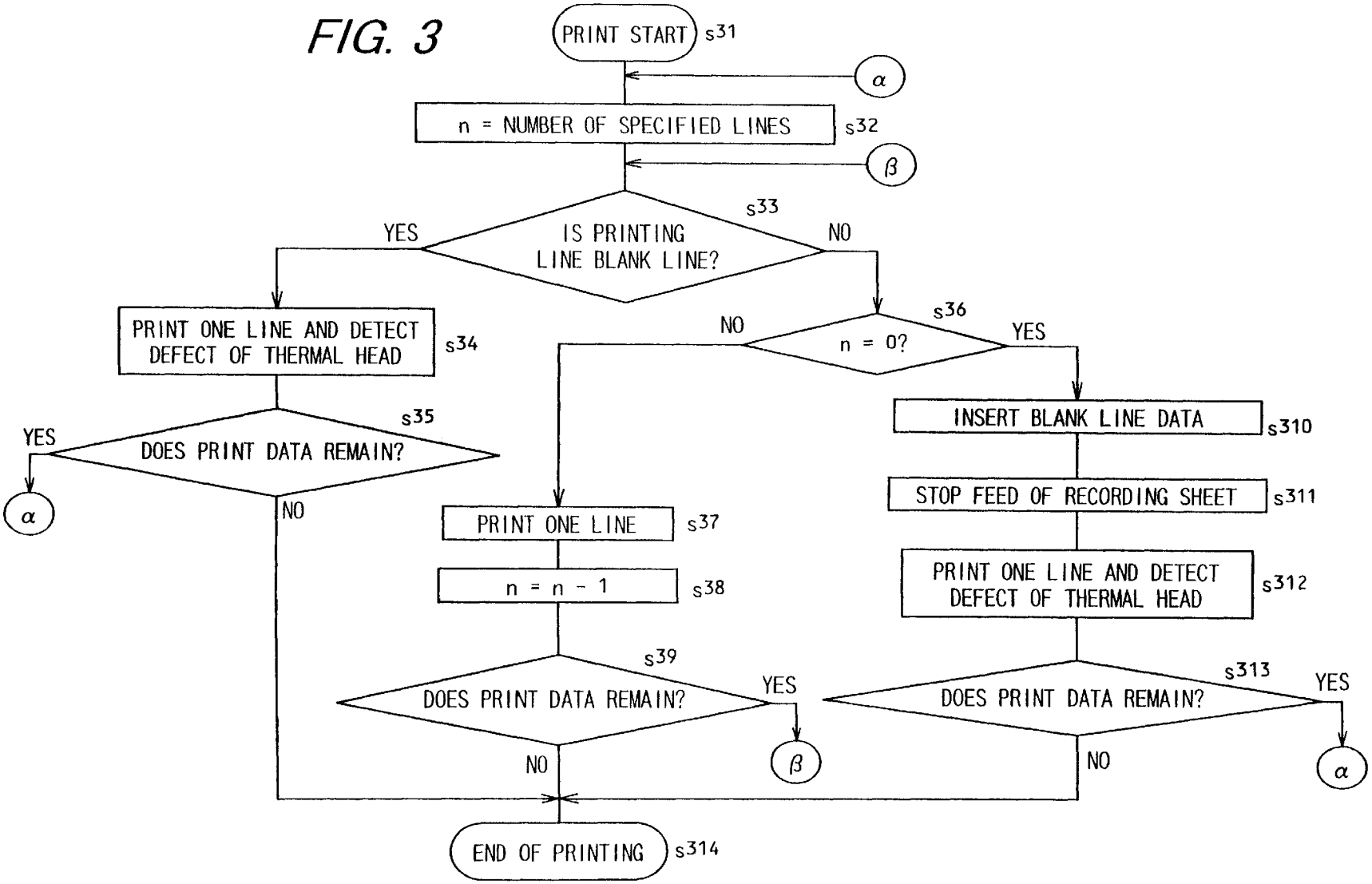
FIG. 3 is a flowchart showing an operation at the time of printing of the printing apparatus 7.

Next, the operation of the printing apparatus 7 at the time of printing will be described with reference to a flowchart shown in FIG. 3. First, when printing is started at step S31, the procedure proceeds to step S32. At the step S32, even if print data to cause all of one line to be blank is not inputted to the thermal head 20 in a fixed amount of printing, the number n of printing lines for detection of a defect of the thermal head 20 is set. The number n of printing lines is a set value for detecting the defect of the thermal head each time the lines the number of which is the value n are printed. At the step S32, in the case where the number of pages, the length of printing or the like is used as the printing amount for detection of the defect of the thermal head, since it can be easily achieved by slightly correcting this flowchart, it is omitted here.

Next, the procedure proceeds to step S33. At the step S33, it is judged whether or not the print data to cause all of one line to be blank is inputted to the thermal head 20. At the step S33, when the judgement is YES, that is, in the case where the print data to cause all of one printed line to be blank is inputted to the thermal head 20, the procedure proceeds to step S34. At the step S34, the line which becomes blank is printed, and in parallel to that, the defect of the thermal head 20 is detected. Thereafter, the procedure proceeds to step S35, and it is judged whether or not print data remains. In the case where the judgement at the step S35 is YES, that is, in the case where the print data remains, the procedure is returned to the step S32 and the printing continues, and in the case where the judgement at the step S35 is NO, that is, the print data does not remain, the procedure proceeds to step S314 and the printing is ended.

On the other hand, in the case of NO at the step S33, that is, in the case where the print data to cause all of one line to be blank is not inputted to the thermal head 20, the procedure proceeds to step S36. At the step S36, it is judged whether or not a printing line is a line specified at the step S32. In the case where the judgement at the step S36 is NO, that is, it is judged that the line is not the specified line, the procedure proceeds to step S37. At the step S37, the printing of one line is carried out, and thereafter, the procedure proceeds to step S38. At the step S38, one is subtracted from the specified number n of lines to make n=n−1, and thereafter, the procedure proceeds to step S39. At the step S39, it is judged whether or not the print data remains. In the case where the judgement at the step S39 is YES, that is, when the print data remains, the procedure is returned to the step S33 and the printing continues, and in the case where the judgement is NO, that is, when the print data does not remain, the procedure proceeds to the step S314 and the printing is ended.

When the judgement at the step S36 is n=0, that is, the specified number of lines, the procedure proceeds to step S310, and the print data to cause all of one data to be blank is inserted. Next, the procedure proceeds to step S311, and the feed of the recording sheet is stopped. Thereafter, the procedure proceeds to step S312, and similarly to the step S34, the line which becomes blank is printed, and in parallel with that, the defect of the thermal head 20 is detected. In this way, since the print data to cause all of one line to be blank is forcibly inserted every predetermined printing amount, even in the case where the print data to cause all of one line to be blank does not exist in the image to be printed, the detection of the defect of the thermal head 20 can be certainly carried out. In the case where the print data to cause all of one line to be blank is forcibly inserted, the feed of the recording sheet is stopped, so that the blank line is not printed.

Next, the procedure proceeds to step S313, and it is judged whether or not the print data remains. In the case where the judgement at the step S313 is YES, that is, when the print data remains, the procedure is returned to the step S33, and in the case where the judgement is NO, that is, when the print data does not remain, the procedure proceeds to the step S314 and the printing is ended.

Figure 4:
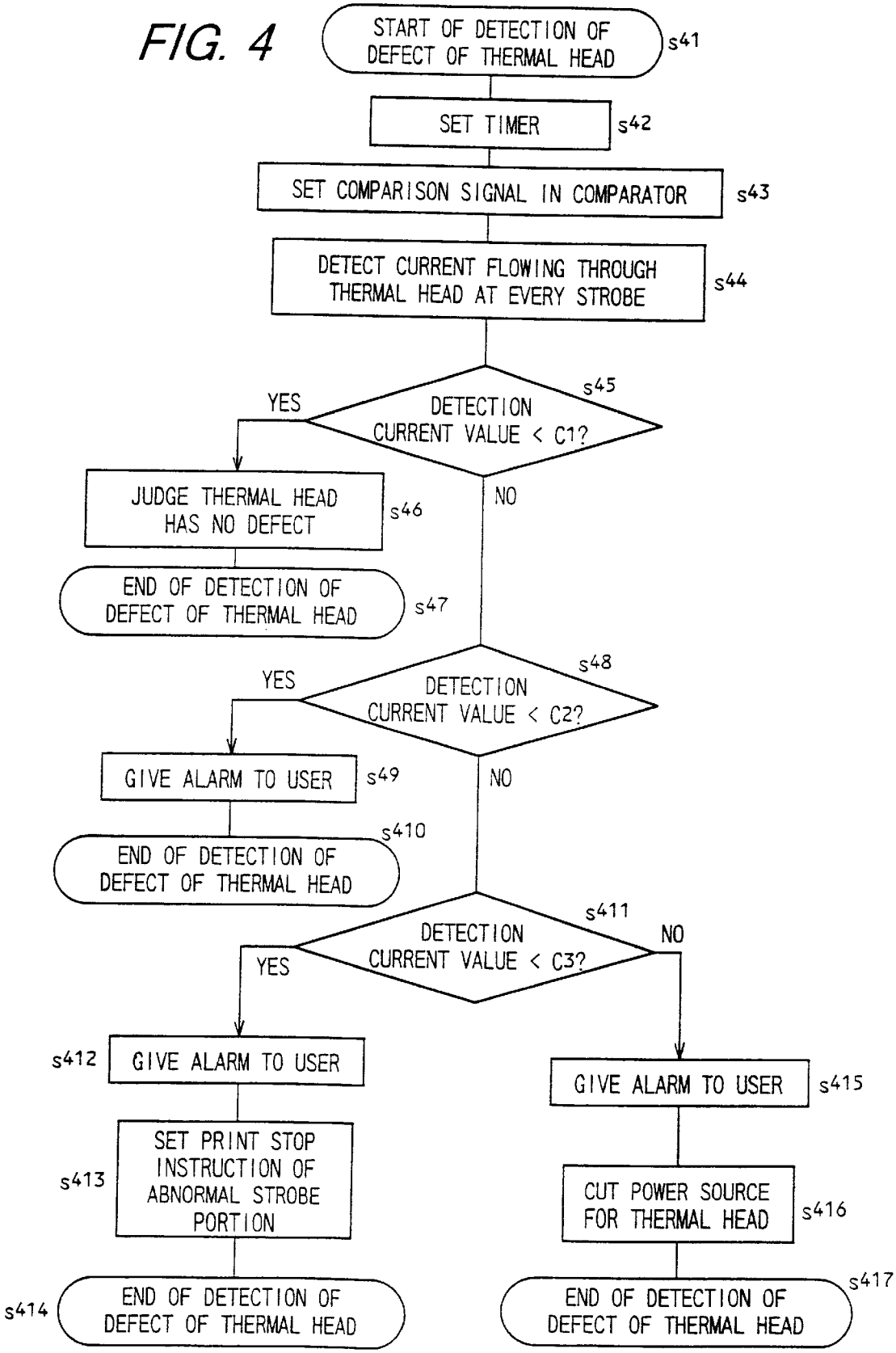
FIG. 4 is a flowchart showing a detection operation of a defect of a thermal head.

Next, a specific operation of the detection of the defect of the thermal head 20 at the step S34 and the step S312 will be described with reference to a flowchart shown in FIG. 4. First, when printing of the blank line is started, in parallel with that, detection of the defect of the thermal head is started at step S41. Next, the procedure proceeds to step S42, and the timer 15 is set. This timer 15 is a timer used in a procedure of confirming the thermal head each time a fixed time elapses, as described later, and here, for the purpose of detecting the defect of the thermal head 20, it is necessary to return the timer 15 to the initial value. Next, the procedure proceeds to step S43. At the step S43, the comparison signal 41 from the control unit 10 is converted by the DA converter 39, and is inputted to the comparator 40. Thereafter, the procedure proceeds to step S44.

There are three kinds of comparison signals 41, and these are denoted by a comparison signal 41C1, a comparison signal 41C2, and a comparison signal 41C3. These comparison signals 41 are successively set, are converted into level signals by the DA converter 39, and are applied to the comparator 40. At the step S44, the transistor 33 is made to have an OFF state by the S signal 34 inputted from the control unit 10 to the photo coupler 35, the current detection resistor 32 is made conductive, and the voltage value corresponding to the current value for detection of the defect of the thermal head 20 is converted by the current detection resistor 32 and is inputted to the comparator 40. At this time, the current of the thermal head 20 is detected for every block corresponding to a strobe signal. The operation subsequent to step S45 is successively repeated in the detection of the defect corresponding to the first strobe 26 to the fourth strobe 29.

After the current flowing through the thermal head 20 is detected at the step S44, the procedure proceeds to the step S45. At the step S45, when the print data to cause all of one line to be blank is inputted to the thermal head, it is judged based on the comparison result 42 of the comparator 40 by the control unit 10 whether or not a value of a current (hereinafter referred to as a detection current value) flowing through the thermal head 20 is smaller than the comparison signal 41C1 (hereinafter abbreviated to C1), that is, whether or not the detection current value<C1 is satisfied. The value of C1 compared with the detection current value at the step S45 is set to a current value which is judged not to be unsuitable for a value of the sum of leak currents of the circuits for driving the respective heaters 25 of the thermal head 20. In the case where the judgement at the step S45 is YES, that is, the detection current of the thermal head 20 to be detected is smaller than C1, the procedure proceeds to step S46. At the step S46, it is judged that there is no defect in the thermal head 20, and the procedure proceeds to step S47. At the step S47, the operation of the detection of the defect of the thermal head is ended, and the procedure is again returned to the operation of the printing shown in FIG. 3.

On the other hand, in the case where the judgement at the step S45 is NO, that is, it is judged that the detection current value is larger than C1, the procedure proceeds to step S48. At the step S48, it is judged based on the comparison result 42 of the comparator 40 by the control unit 10 whether or not the detection current value is smaller than the comparison signal 41C2 (hereinafter abbreviated to C2), that is, whether or not the detection current value<C2 is satisfied. The value of C2 compared with the detection current value at the step S48 is set to such a level that the defect of the thermal head is small, and the printing may continue as it is. In the case where the judgement at the step S48 is YES, that is, when the detection current value is smaller than C2, the procedure proceeds to step S49. At the step S49, an alarm is given to the user by using the display panel 14 or the like, and thereafter, the procedure proceeds to step S410, the operation of the detection of the defect of the thermal head 20 is ended, and the procedure is again returned to the operation of the printing shown in FIG. 3.

In the case where the judgement at the step S48 is NO, that is, the detection current value is larger than the comparison signal C2, the procedure proceeds to step S411. At the, step S411, it is judged based on the comparison result 42 of the comparator 40 by the control unit 10 whether or not the detection current value is smaller than the comparison signal 41C3 (hereinafter abbreviated to C3), that is, whether or not the detection current value<C3 is satisfied. The value of C3 compared with the detection current value at the step S411 is set to such a level that although a great influence is exerted on the quality of an image of a strobe region, a fatal defect such as heat generation does not occur. In the case where the judgement at the step S411 is YES, that is, when the detection current value is smaller than C3, the procedure proceeds to step S412. At the step S412, an alarm is given to the user by using the display panel 14 or the like, and thereafter, the procedure proceeds to step S413. At the step S413, the printing of the strobe portion having the defect is stopped, and thereafter, the procedure proceeds to step S414, the operation of the detection of the defect of the thermal head 20 is ended, and the procedure is again returned to the operation of the printing shown in FIG. 3.

In the case where the judgement at the step S411 is NO, that is, when it is judged that the detection voltage is larger than the comparison signal C3, the procedure proceeds to step S415. At the step S415, an alarm is given to the user by using the display panel 14 or the like, and thereafter, the procedure proceeds to step S416. At the step S416, the current to the thermal head is cut off. Next, the procedure proceeds to step S417, and the defect detection of the thermal head 20 is ended. However, in this case, the procedure is returned to the step S314 of the flowchart shown in FIG. 3, and the printing is ended.

As described above, in the case where the print data to cause all of one line to be blank is inputted to the thermal head 20, the defect of the thermal head 20 is detected based on the current flowing through the thermal head 20, so that it is possible to prevent the trouble such as destruction and burnout of the thermal head 20, which is caused by heat generation of the heater 25. Besides, in this embodiment, although the number of lines is used as the amount of printing, a method may be used in which irrespective of whether or not all of one line is blank, blank data of one line is forcibly inserted every predetermined printing amount, for example, in the first line of every page.

Figure 5:
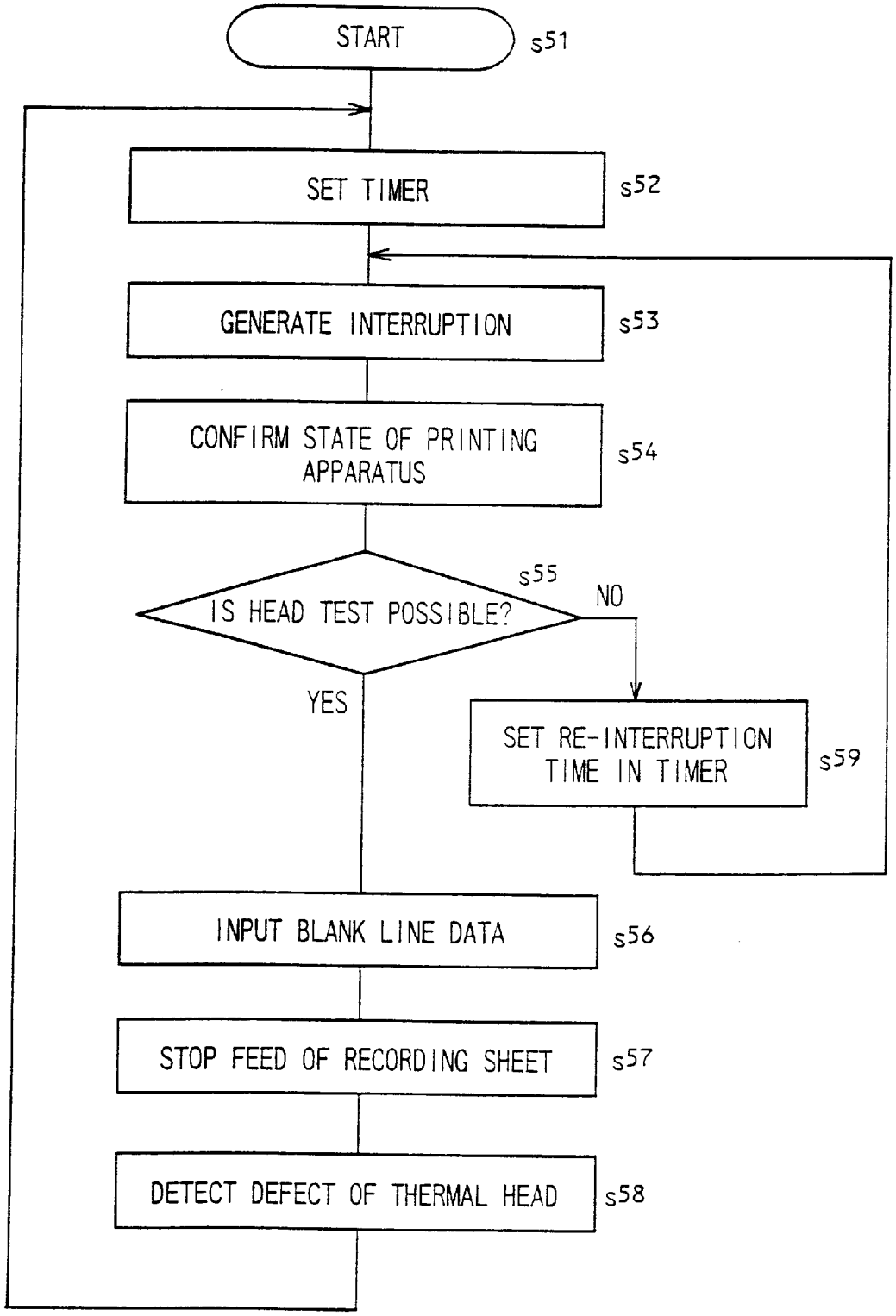
FIG. 5 is a flowchart showing a detection operation of a defect of a thermal head at an ordinary time.

Although the above is the operation of the detection of the defect of the thermal head 20 at the time of printing, the trouble of a circuit portion of the thermal head 20 does not always occur at the time of printing. That is, such a case can also be imagined that irrespective of the printing time, the thermal head suddenly fails, or a control program runs violently, and a current is continuously supplied to the thermal head 20, so that the trouble such as destruction and burnout of the thermal head 20 occurs by the heat generation of the heater 25. Thus, it is necessary to carry out the detection of the defect of the thermal head every fixed period over a period including the printing time and the waiting state. Thus, over a period (hereinafter referred to as an ordinary time) including the print processing time of the printing apparatus 7 of the facsimile apparatus 1 of this embodiment and the waiting state, the defect of the thermal head 20 is detected each time a predetermined time elapses. The operation for detecting the defect of the thermal head 20 performed every fixed period will be described with reference to a flowchart shown in FIG. 5. First, when a detection operation of the defect of the thermal head 20 at the ordinary time is started at step S51, the procedure proceeds to step S52. At the step S52, the timer 15 is set. When the set time elapses, the timer 15 interrupts the control unit 10, and forcibly causes the detection operation of the defect of the thermal head 20 shown in FIG. 5 to be performed. The timer 15 may be set by the user, or may be automatically set by the control unit 10. Next, the procedure proceeds to step S53.

At the step S53, when the time set by the timer 15 elapses, an interrupt is generated in the control unit 10 irrespective of the printing state or the waiting state. Next, at step S54, it is judged whether the printing apparatus 7 is under printing or in the waiting state, and the procedure proceeds to step S55. At the step S55, it is judged whether or not the detection of the defect of the thermal head 20 is possible. In the case where the judgement here is YES, that is, when the detection of the defect of the thermal head 20 is possible, the procedure proceeds to step S56, print data to cause all of one line to be blank is inserted, and the procedure proceeds to step S57.

After the feed of a recording sheet is stopped at the step S57, the procedure proceeds to step S58, and the defect of the thermal head 20 is detected. Here, the defect of the thermal head 20 is detected in accordance with the detection operation of the defect of the thermal head 20 shown in FIG. 4. Here, for example, in the detection operation of the defect of the thermal head 20 shown in FIG. 4, in the case where the defect of the thermal head is found in the case other than the printing, since the defect is often fatal, with respect to a predetermined current, for example, in the case of the judgement of NO at the step S48 of FIG. 4, that is, in the case where the detection current value is not smaller than C2, the current of the thermal head may be cut off. After the detection of the defect of the thermal head 20 is ended at the step S58, the procedure is again returned to the step S52.

On the other hand, especially in the case where the control unit 10 performs an emergency job, the judgement at the step S55 is NO, and the procedure proceeds to step S59. At the step S59, the timer is again set. Thereafter, when the set time again elapses, the procedure is returned to the step S53. At the step S53, a time shorter than the time set at the step S52 is set.

Besides, in this embodiment, for the purpose of detecting the thermal head 20, not the current value of the thermal head 20 in the case where the print data to cause all of one line to be blank is inputted, but, when the time set by the timer 15 elapses, the current value of the thermal head 20 at the point of time when the strobe signal is not inputted may be detected.

As described above, according to the invention, not only at the time of the printing, but also over the period including the waiting state, the defect of the thermal head can be detected each time a predetermined time elapses. Accordingly, irrespective of the printing, the defect of the thermal head can always be detected, so that the trouble such as destruction and burnout of the thermal head 20 caused by the heat generation of the heater 25 can be prevented. However, according to the content of the trouble, for example, in the case where the program falls into an infinite loop, it is expected that the procedure always proceeds to the side of NO at the judgement step S55. In that case, although not shown in the drawing, it is also possible to adopt a method in which a second timer is further added, and a long time is set by the second timer, and in the case where a time when the second timer does not confirm the thermal head exceeds the set time of the timer set at the step S52, the confirmation of the thermal head is forcibly carried out, or at the judgement step S55, in the case where the judgement of NO is performed a predetermined number of times, the procedure is made to forcibly proceed to the side of YES at the judgement step S55.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A printing apparatus comprising:

a line type thermal head having a heater array composed of a plurality of heaters, for printing on a recording sheet; and defect detection means for, in the case where print data to cause all of one line to be blank is inputted to the thermal head, detecting a defect of the thermal head based on a current flowing through each heater at a time of printing of the blank line and, wherein the defect detection means comprises a resistor which is interposed in a power source line of the thermal head and detects a current supplied to the thermal head when print data to cause all of one line to be blank is inputted to the thermal head, and a circuit for short-circuiting the resistor in the case where all of one line is not blank.

2. The printing apparatus of claim 1, wherein the print data for one line is divided into a plurality of parts of data by strobe signals, and wherein said parts of data are printed in different print timings, and a defect detection of the thermal head is carried out for respective parts of data as divided by the strobe signals.

3. The printing apparatus of claim 1, wherein the defect detected by the defect detection means is classified into a plurality of stages in accordance with the stage of the defect, a processing after defect detection is also classified into a plurality of stages made of a combination of an alarm occurrence and a printing stop, and a processing classification after the defect detection is assigned in accordance with the classification of the defect.

4. The printing apparatus of claim 1, wherein in the case where print data to cause all data of one line to be blank is not inputted to the thermal head with respect to a predetermined printing amount, or every predetermined printing amount, print data to cause all of one line to be blank is forcibly inserted.

5. The printing apparatus of claim 4, wherein when the print data to cause all of one line to be blank is forcibly inserted, a recording sheet is not advanced in printing of this line.

6. The printing apparatus of claim 1; and wherein said apparatus can be used for communication apparatus.

7. The printing apparatus of claim 1; and wherein said apparatus can be used for information processing apparatus.

8. A printing apparatus comprising:

a line type thermal head having a heater array composed of a plurality of heaters, for printing on a recording sheet; and defect detection means for, over a period including a printing time and a waiting state, detecting a current flowing through the thermal head by inserting print data to cause all of one line to be blank each time when a predetermined time elapses, or detecting the current flowing through the thermal head to a point of time when a strobe signal is not inputted, and detecting a defect of the thermal head based on the detected current.

9. The printing apparatus of claim 8, wherein when the detection means detects the defect of the thermal head, a current to the thermal head is cut off.

10. The printing apparatus of claim 7; and wherein said apparatus can be used for communication apparatus.

11. The printing apparatus of claim 8; and wherein said apparatus can be used for information processing apparatus.

12. A printing apparatus comprising:

a line type thermal head having a heater array composed of a plurality of heaters, for printing on a recording sheet; and defect detection means for, in the case where print data to cause all of one line to be blank is inputted to the thermal head, detecting a defect of the thermal head based on a current flowing through each heater at a time of printing of the blank line and, wherein the defect detection means comprises a resistor which is interposed in a power source line of the thermal bead and detects a current supplied to the thermal head when print data to cause all of one line to be blank is inputted to the thermal head, and a circuit for short-circuiting the resistor in the case where all of one line is not blank, and wherein the defect detected by the defect detection means is classified into a plurality of stages in accordance with the stage of the defect, a processing after defect detection is also classified into a plurality of stages made of a combination of an alarm occurrence and a printing stop, and a processing classification after the defect detection is assigned in accordance with the classification of the defect.

13. A printing apparatus of claim 12, wherein the print data for one line is divided into a plurality of parts of data by strobe signals, and wherein said parts of data are printed in different print timings, and a defect detection of the thermal head is carried out for respective parts of data as divided by the strobe signals.

14. A printing apparatus comprising:

a line type thermal bead having a heater tray composed of a plurality of heaters, for printing on a recording sheet; and defect detection means for, in the case where print data to cause all of one line to be blank is inputted to the thermal head, detecting a defect of the thermal head based on a current flowing through each heater at a time of printing of the blank line and, wherein the defect detection meat-is comprises a resistor which is interposed in a power source line of the thermal head and detects a current supplied to the thermal head when print data to cause all of one line to be blank is inputted to the thermal head, and a circuit for short-circuiting the resistor in the case where all of one line is not blank, and wherein in the case where print data to cause all data of one line to be blank is not inputted to the thermal head with respect to a predetermined printing amount, or every predetermined printing amount, print data to cause all of one line to be blank is forcibly inserted.

15. A printing apparatus of claim 14, wherein the print data for one line is divided into a plurality of parts of data by strobe signals, and wherein said parts of data are printed in different print timings, and a defect detection of the thermal head is carried out for respective parts of data as divided by the strobe signals.

16. A printing apparatus of claim 14, wherein when the print data to cause all of one line to be blank is forcibly inserted, a recording sheet is not advanced in printing of this line.

* * * * *